US010407811B2

(12) United States Patent
Ueda et al.

(10) Patent No.: US 10,407,811 B2
(45) Date of Patent: Sep. 10, 2019

(54) SEWING MACHINE

(71) Applicant: BROTHER KOGYO KABUSHIKI KAISHA, Nagoya-shi, Aichi-ken (JP)

(72) Inventors: Daisuke Ueda, Owariasahi (JP); Mitsuhiro Iida, Gifu (JP); Masayuki Hori, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 163 days.

(21) Appl. No.: 15/715,889

(22) Filed: Sep. 26, 2017

(65) Prior Publication Data

US 2018/0016722 A1 Jan. 18, 2018

Related U.S. Application Data

(63) Continuation of application No. PCT/JP2016/069414, filed on Jun. 30, 2016.

(30) Foreign Application Priority Data

Sep. 4, 2015 (JP) ..... 2015-174282

(51) Int. Cl.
*D05B 29/02* (2006.01)
*D05B 29/10* (2006.01)

(52) U.S. Cl.
CPC ..... *D05B 29/02* (2013.01); *D05B 29/10* (2013.01)

(58) Field of Classification Search
CPC ..... D05B 29/00; D05B 29/02
USPC ..... 112/235–237, 239, 244, 284
See application file for complete search history.

(56) References Cited

U.S. PATENT DOCUMENTS 3,815,532 A * 6/1974 Weisz ..... D05B 55/16 112/221
4,060,045 A * 11/1977 Vahle ..... D05B 29/02 112/235
4,915,044 A * 4/1990 Kambara ..... D05B 29/02 112/221

(Continued)

FOREIGN PATENT DOCUMENTS

DE 19820646 A1 * 11/1998 ..... D05B 29/02
DE 102008004855 A1 * 8/2008 ..... D05B 29/02

(Continued)

OTHER PUBLICATIONS

Sep. 13, 2016 International Search Report issued in Patent Application No. PCT/JP2016/069414.

*Primary Examiner* — Nathan E Durham
(74) *Attorney, Agent, or Firm* — Oliff PLC

(57) ABSTRACT

A sewing machine includes a drive shaft rotated by a motor, a cam member fixed to the drive shaft and including a first cam and a second cam, a forked member including a main body member and an auxiliary member, an urging device, and a presser mechanism. At least one of a first cam surface of the first cam and a second cam surface of the second cam is inclined with respect to the drive shaft. The main body member and the auxiliary member are disposed to face each other such that the cam member is clamped between them. The urging device urges the main body member and the auxiliary member in a direction to clamp the cam member. The presser mechanism drives a presser member to hold a cloth, by swinging of the forked member caused by the rotation of the cam member.

7 Claims, 16 Drawing Sheets

(56) References Cited

U.S. PATENT DOCUMENTS

| | | | | |
|---|---|---|---|---|
| 6,591,769 | B1 * | 7/2003 | Heidtmann | D05B 29/02 112/237 |
| 2002/0062774 | A1 * | 5/2002 | Sano | D05B 29/02 112/237 |
| 2007/0163477 | A1 * | 7/2007 | Nagata | D05B 27/06 112/237 |
| 2008/0282953 | A1 * | 11/2008 | Joe | D05B 29/02 112/239 |
| 2009/0007830 | A1 * | 1/2009 | Sakuma | D05B 1/02 112/475.17 |
| 2011/0203505 | A1 * | 8/2011 | Nagai | D05B 29/02 112/235 |
| 2015/0233033 | A1 * | 8/2015 | Sakuma | D05B 29/02 112/237 |

FOREIGN PATENT DOCUMENTS

| | | | |
|---|---|---|---|
| EP | 2 351 881 | A1 | 8/2011 |
| JP | S49-075975 | A | 7/1974 |
| JP | H06-109093 | A | 4/1994 |
| JP | H06-126056 | A | 5/1994 |
| JP | 2001-259272 | A | 9/2001 |

* cited by examiner

SEWING MACHINE

CROSS-REFERENCE TO RELATED APPLICATION

This application is a Continuing Application of International Application No. PCT/JP2016/069414, filed Jun. 30, 2016, which claims priority from Japanese Patent Application No. 2015-174282, filed on Sep. 4, 2015. This disclosure of the foregoing application is hereby incorporated by reference in its entirety.

BACKGROUND

The present disclosure relates to a sewing machine.

A sewing machine provided with a cloth presser device is known. The cloth presser device drives a presser member that holds down a cloth, in synchronization with driving of a needle bar. A drive shaft of the sewing machine is provided with a column-shaped drive cam. An outer peripheral surface of the drive cam is provided with a cam groove for driving a cloth presser foot. A roller is attached to the leading end of an arm portion of a lever such that the position of the roller is adjustable. The roller engages with the cam groove for driving the cloth presser foot. When the drive cam is rotated by the rotation of the drive shaft, the lever swings in accordance with the movement of the roller. The lever drives the cloth presser device.

SUMMARY

A portion at which the cam groove and the roller engage with each other has a slight gap (backlash) in a width direction of the cam groove. Therefore, the operation of the presser member is not stable, and there is a possibility of occurrence of noise.

It is an object of the present disclosure to provide a sewing machine capable of stably driving a presser member that holds down a cloth.

An aspect of the present disclosure provides a sewing machine including a drive shaft, a cam member, a forked member, an urging device, and a presser mechanism. The drive shaft is configured to be rotated by a sewing machine motor. The cam member includes a first cam and a second cam. The first cam has an outer periphery on which a first cam surface is formed. The second cam has an outer periphery on which a second cam surface, whose shape is different from that of the first cam surface, is formed. The first cam and the second cam are provided side by side in an extending direction of the drive shaft. At least one of the first cam surface and the second cam surface is inclined with respect to the extending direction of the drive shaft. The cam member is fixed to the drive shaft and rotates integrally with the drive shaft. The forked member includes a main body member and an auxiliary member. The main body member is swingably and pivotally supported by a pivotally supporting shaft fixed to a machine frame of the sewing machine. The pivotally supporting shaft is provided parallel to the drive shaft. The auxiliary member is swingably supported by the main body member. The main body member and the auxiliary member are disposed to face each other such that the cam member is clamped between the main body member and the auxiliary member. The urging device is configured to constantly urge the main body member and the auxiliary member in a direction to clamp the cam member. The presser mechanism is configured to drive a presser member, which holds down a cloth, by swinging of the forked member caused by the rotation of the cam member.

BRIEF DESCRIPTION OF THE DRAWINGS

Embodiments of the disclosure will be described below in detail with reference to the accompanying drawings in which.

DETAILED DESCRIPTION OF EMBODIMENTS

Figure 1:
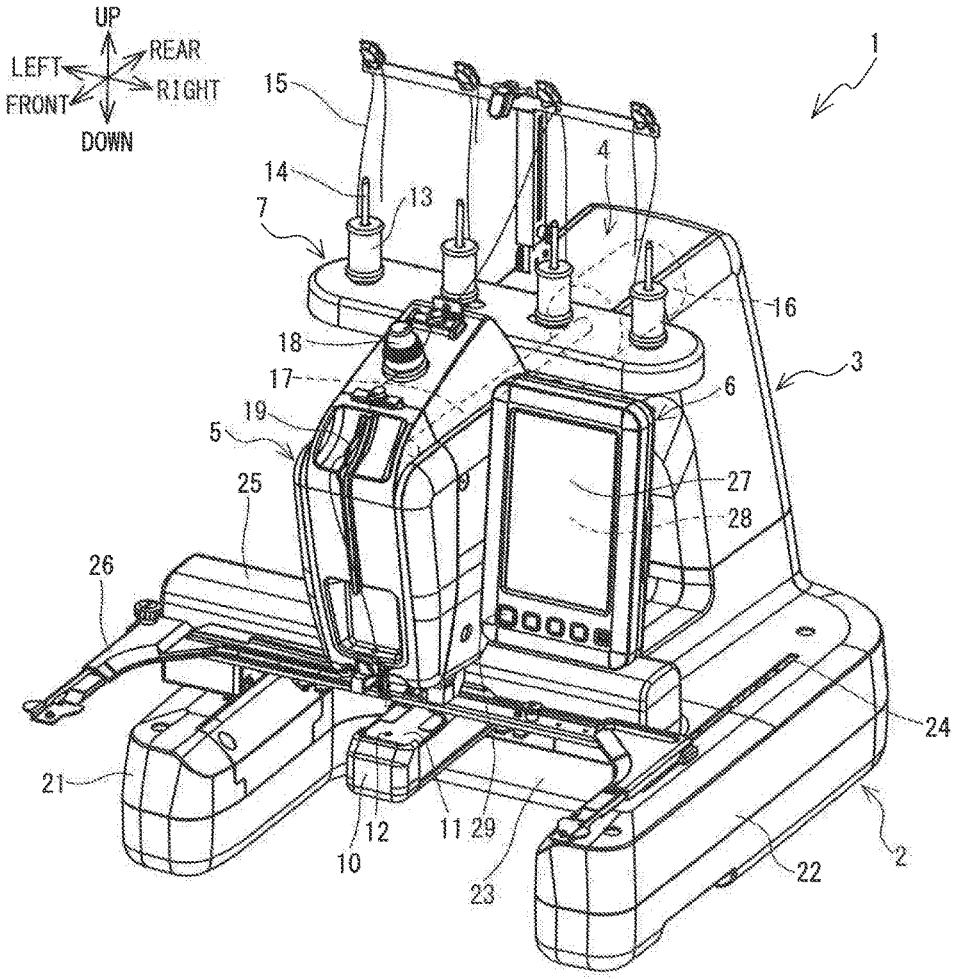
FIG. 1 is a perspective view of a sewing machine.

Hereinafter, an embodiment of the present disclosure will be explained with reference to the drawings. Note that the drawings are used to explain technological features that can be adopted by the present disclosure, and are not intended to limit the content. In the following explanation, left and right directions, front and rear directions, and up and down directions as indicated by arrows in the drawings are used.

The structure of a sewing machine 1 will be explained with reference to FIG. 1 to FIG. 3. As shown in FIG. 1, the sewing machine 1 is provided with a support portion 2, a pillar 3, an arm portion 4 and the like. The support portion 2 supports the whole of the sewing machine 1. The pillar 3 is provided on a rear end portion of the support portion 2, and extends upward. The arm portion 4 extends forward from an upper end portion of the pillar 3 such that the arm portion 4 faces a cylinder bed 10 to be described later. A head portion 5 is provided on a front end portion of the arm portion 4.

The support portion 2 is formed in a substantially U-shape in a plan view. The support portion 2 is provided with a pair of leg portions 21 and 22 and a base portion 23. The pair of leg portions 21 and 22 each extend in the front-rear direction, and are disposed side by side in the left-right direction. The base portion 23 is disposed between the leg portion 21 and the leg portion 22, on a rear side of each of the leg portions 21 and 22. The base portion 23 extends in the left-right direction and connects the leg portion 21 and the leg portion 22.

The cylinder bed 10, which has a cylindrical shape and extends forward, is provided at substantially the center in the left-right direction of the base portion 23. A cloth (not shown in the drawings) is disposed on a top surface of the cylinder bed 10. A shuttle mechanism (not shown in the drawings) is provided inside the cylinder bed 10. A lower shaft (not shown in the drawings) is provided such that it extends from the inside of the base portion 23 to the inside of the cylinder bed 10. The lower shaft is driven to rotate by a drive shaft 17 to be described later. A driving force of a sewing machine motor 16, which will be described later, is transmitted to the shuttle mechanism via the lower shaft. The shuttle mechanism drives and rotates a shuttle (not shown in the drawings) disposed inside a leading end portion of the cylinder bed 10. The shuttle houses a bobbin (not shown in the drawings) around which a lower thread (not shown in the drawings) is wound.

A needle plate 11 having a rectangular shape in a plan view is provided on a top surface of the leading end portion of the cylinder bed 10. The needle plate 11 is disposed above the shuttle. A needle hole 12 is formed in the needle plate 11. A sewing needle 9 mounted on a lower end portion of a needle bar 30 (refer to FIG. 2), which will be described later, is inserted through the needle hole 12. A cloth presser foot 38 (refer to FIG. 2 and FIG. 3), which has a substantially L shape in a front view, is provided to the left of the sewing needle 9. The cloth presser foot 38 holds down a cloth (not shown in the drawings) placed on the needle plate 11. A hole 38A (refer to FIG. 2), through which the sewing needle 9 is inserted, is formed in a lower end portion of the cloth presser foot 38.

As shown in FIG. 1, a pair of guide grooves 24 that extend in the front-rear direction are formed in top surfaces of the respective leg portions 21 and 22. The pair of guide grooves 24 guide the movement of a carriage 25 in the front-rear direction. The carriage 25 extends in the left-right direction, and forms a bridge between the pair of leg portions 21 and 22. A movement mechanism (not shown in the drawings) is provided inside the carriage 25. The movement mechanism causes a holder 26, which is disposed on the front side of the carriage 25, to move in the left-right direction. An embroidery frame (not shown in the drawings) that holds the cloth is mounted on the holder 26. The sewing machine 1 causes the embroidery frame mounted on the holder 26 to move in the front-rear and left-right directions, by the movement of the carriage 25 in the front-rear direction (i.e., the movement of the whole movement mechanism in the front-rear direction) and the movement of the holder 26 in the left-right direction caused by the movement mechanism.

The sewing machine motor 16, a control portion (not shown in the drawings) of the sewing machine 1, and the like are provided inside the pillar 3. The sewing machine motor 16 drives and rotates the drive shaft 17 provided inside the arm portion 4. The drive shaft 17 and the lower shaft inside the support portion 2 are coupled by a timing belt (not shown in the drawings). Thus, the rotation of the drive shaft 17 is transmitted to the lower shaft, and the drive shaft 17 and the lower shaft rotate in synchronization.

The drive shaft 17 is provided inside the arm portion 4, and extends in the front-rear direction. The drive shaft 17 drives a thread take-up lever mechanism 20, a needle bar drive mechanism 40, a cloth presser drive mechanism 60 and the like that are provided inside the head portion 5 and that will be described later. A thread spool stand 7 is provided on a top surface of the arm portion 4. A plurality (four, for example) of thread spool pins 14 are arranged in a standing condition on the thread spool stand 7. The thread spool pins 14 are respectively inserted into holes of a plurality (four, for example) of thread spools 13, around which an upper thread 15 is wound. A plurality of the thread spools 13 can be placed on the thread spool stand 7.

A tensioner 18 is provided on an upper portion of the head portion 5. The tensioner 18 applies a tension to the upper thread 15 supplied from the thread spool stand 7. An operation portion 6 is provided on the right side of the head portion 5. The operation portion 6 is provided with a liquid crystal display 27, a touch panel 28, a start/stop switch 29 and the like. The liquid crystal display 27 displays various types of information such as, for example, an operation screen for a user to input a command. The touch panel 28 receives a command from the user. The start/stop switch 29 is a switch to command the start or stop of sewing.

An internal structure of the head portion 5 will be explained with reference to FIG. 2 to FIG. 7. A machine frame 5A, a needle bar frame 31, the needle bar 30, the thread take-up lever mechanism 20, the needle bar drive mechanism 40, a needle bar release mechanism 50, the cloth presser drive mechanism 60, a drive unit (not shown in the drawings) and the like are provided inside the head portion 5.

The needle bar frame 31 extends in the up-down direction on the front side inside the head portion 5, and is fixed to the machine frame 5A. An upper end portion and a lower end portion of the needle bar frame 31 are provided with an upper support portion 36 and a lower support portion 37. The needle bar 30 extends in the up-down direction on the front side inside the head portion 5, and is supported by the upper support portion 36 and the lower support portion 37 of the needle bar frame 31 such that the needle bar 30 can move up and down. A coupling member 33 is fixed to an intermediate portion of the needle bar 30 in the up-down direction, namely, between the upper support portion 36 and the lower support portion 37. The coupling member 33 is provided with a coupling pin 34 that protrudes outwardly in a radial direction toward the rear. The coupling member 33 is coupled to a transmission member 51, to be described later, of the needle bar release mechanism 50, and transmits the driving force of the sewing machine motor 16 to the needle bar 30.

An annular spacer 35 made of rubber, for example, is fixed to an upper end portion of the coupling member 33. When the needle bar 30 is positioned at a top dead center in a vertically movable range, the spacer 35 abuts against an abutment member 61 (refer to FIG. 3) fixed to the machine frame 5A. A screw 32 is fastened to the upper end of the needle bar 30. An outer diameter of a head portion of the screw 32 is larger than an outer diameter of the needle bar 30. A compression spring (not shown in the drawings) is externally fitted to a portion of an outer peripheral surface of the needle bar 30 between a bearing surface of the head portion of the screw 32 and the upper support portion 36. Since the compression spring presses the bearing surface of the head portion of the screw 32 upward, the needle bar 30 is urged upward. When the coupling member 33 and the transmission member 51 are not coupled, the needle bar 30 moves upward due to the urging force of the compression spring, and is positioned at the top dead center. A lower end portion of the needle bar 30 extends downward from a lower end portion of the head portion 5. The sewing needle 9 is detachably mounted on the lower end portion of the needle bar 30. An eye 9A (refer to FIG. 2), through which the upper thread 15 is inserted, is formed in the sewing needle 9.

Figure 4:
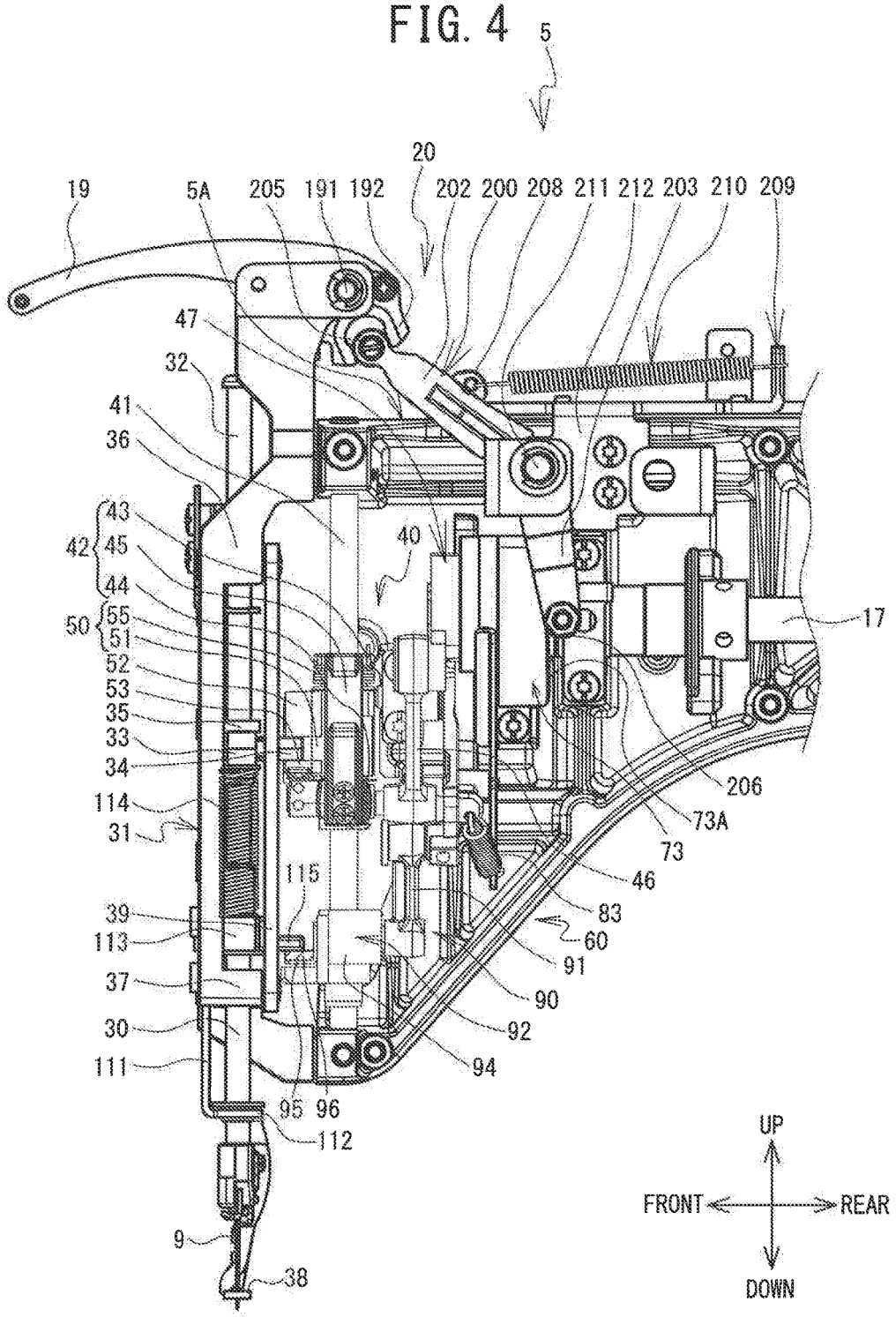
FIG. 4 is a diagram of a part of the internal structure of the head portion as viewed from the right side of the sewing machine.

As shown in FIG. 4, the thread take-up lever mechanism 20 is provided with a thread take-up lever 19, a link member 200, a tension spring 210 and the like. The thread take-up lever 19 extends from the rear to the front in a substantially arc shape such that the upper side is convex. A rear end portion of the thread take-up lever 19 is rotatably and axially supported by a support shaft 191 provided on the machine frame 5A. Therefore, a front end portion of the thread take-up lever 19 can swing in the up-down direction around the support shaft 191. The rear end portion of the thread take-up lever 19 is provided with a grip portion 192 that is substantially U-shaped in a side view. The link member 200 is formed in a substantially L shape in a side view, and is provided with a bearing portion 201, a first link portion 202 and a second link portion 203.

The bearing portion 201 is provided at a substantially central portion of the link member 200, and is formed in a substantially cylindrical shape having a through hole (not shown in the drawings) that extends in the left-right direction. A shaft 211 that is supported by a holder 212 fixed to the machine frame 5A is inserted through the through hole of the bearing portion 201, and is rotatably and axially supported. The first link portion 202 extends diagonally upward from the bearing portion 201 toward the rear end portion of the thread take-up lever 19. A working portion 205 is provided at a leading end portion of the first link portion 202. A roller (not shown in the drawings), which is inserted into and engages with the inside of the grip portion 192 of the thread take-up lever 19, is rotatably provided on the working portion 205. The second link portion 203 extends diagonally downward and rearward from the bearing portion 201, and a rear end portion of the second link portion 203 is provided with a sliding portion 206. A roller (not shown in the drawings) is rotatably provided on the sliding portion 206. The roller of the sliding portion 206 abuts against a third cam surface 73A of a thread take-up lever cam 73 fixed to the drive shaft 17. Note that, although details will be described later, the thread take-up lever cam 73 is formed on the rear end of the composite cam 70.

The tension spring 210 is stretched in the front-rear direction between a spring fixing portion 208 provided on an upper end portion of the first link portion 202 of the link member 200, and a spring fixing portion 209 formed on the holder 212 fixed to the machine frame 5A. The tension spring 210 constantly urges the first link portion 202 to the rear. That is, the link member 200 is constantly urged in the clockwise direction in a right side view around the bearing portion 201. Therefore, the roller of the sliding portion 206 of the second link portion 203 constantly abuts against the third cam surface 73A of the thread take-up lever cam 73.

When the drive shaft 17 rotates due to the driving of the sewing machine motor 16, the thread take-up lever cam 73 rotates. Due to the rotation of the thread take-up lever cam 73, the second link portion 203, i.e., the link member 200, swings in accordance with the shape of the third cam surface 73A of the thread take-up lever cam 73. Due to the swinging of the link member 200, the working portion 205 of the first link portion 202 causes the grip portion 192 to swing. Due to the swinging of the grip portion 192, the leading end (the front end) of the thread take-up lever 19 swings in the up-down direction around the support shaft 191. In this manner, the thread take-up lever mechanism 20 causes the thread take-up lever 19 to move up and down in accordance with the rotation of the drive shaft 17. Further, the thread take-up lever 19 moves up and down in synchronization with the needle bar 30. During the sewing, the needle bar 30 operates in cooperation with the shuttle, and causes the upper thread 15 inserted through the eye 9A of the sewing needle 9 to be entwined with the lower thread pulled out from the bobbin housed in the shuttle. The thread take-up lever 19 pulls the upper thread 15 that has been entwined with the lower thread up to a position above the needle plate 11. Thus, the upper thread 15 and the lower thread are fastened and stitches are formed on the cloth.

Figure 2:
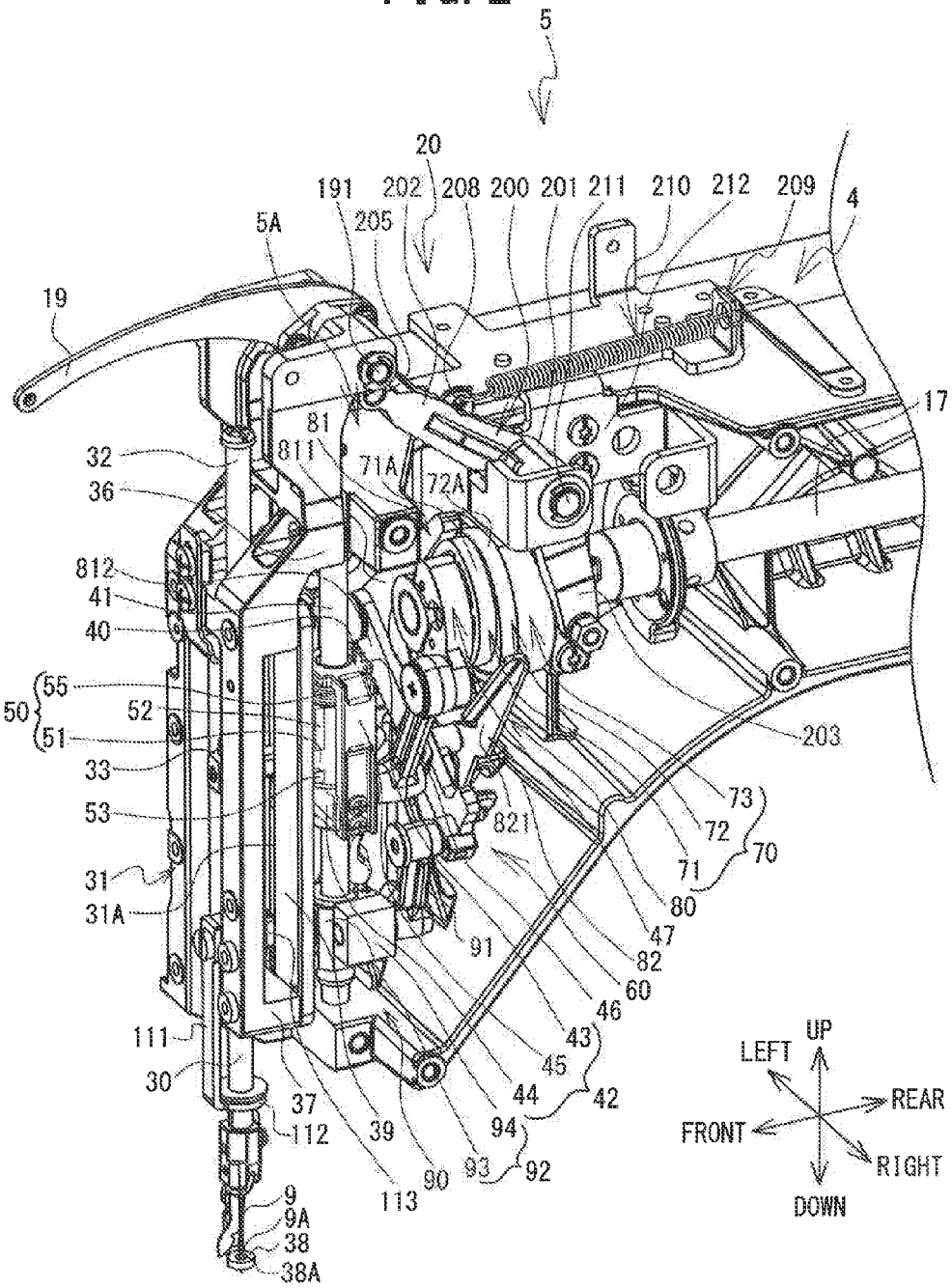
FIG. 2 is a diagram of a part of an internal structure of a head portion as viewed from the front right side of the sewing machine.
Figure 3:
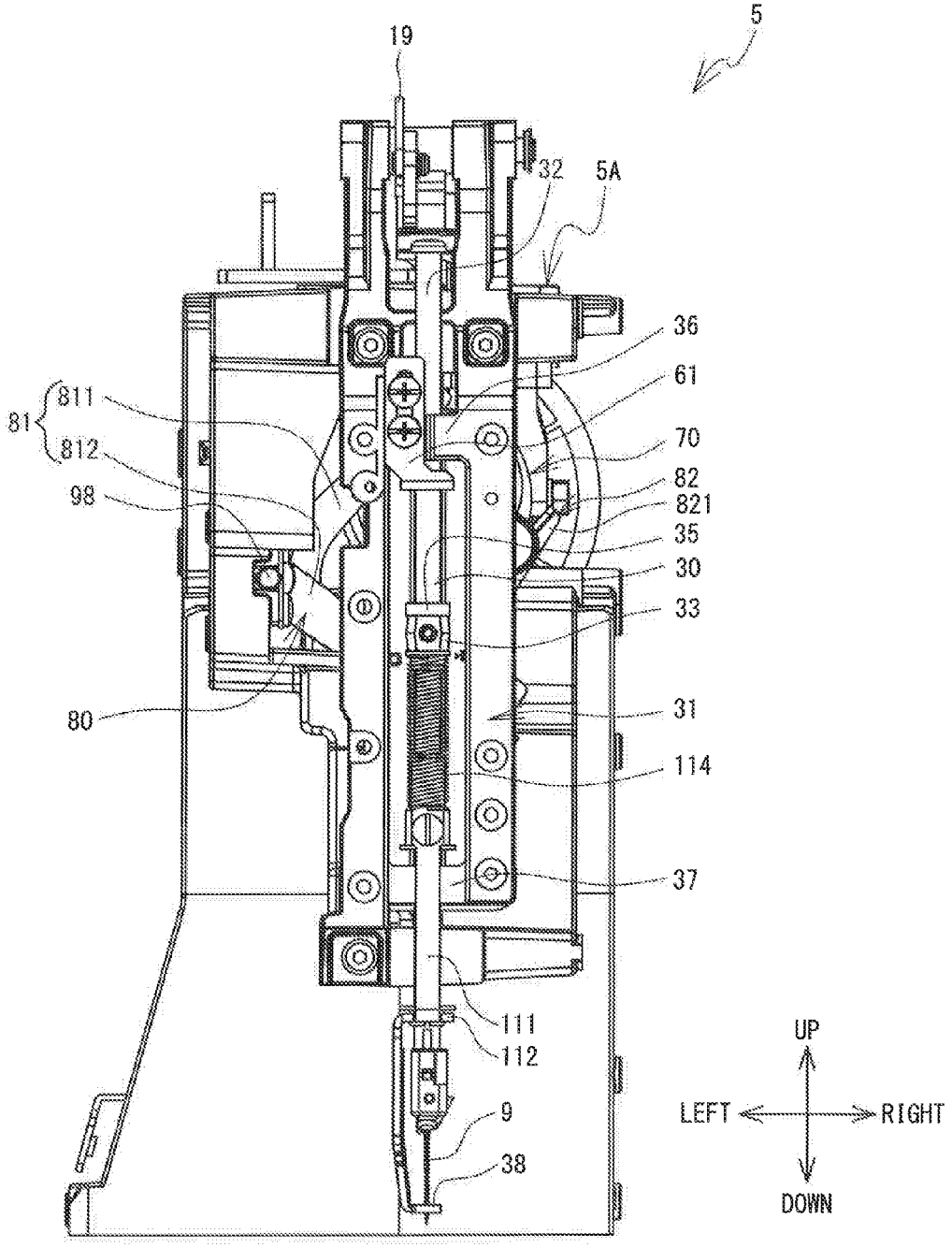
FIG. 3 is a diagram of a part of the internal structure of the head portion as viewed from the front side of the sewing machine.

As shown in FIG. 2 and FIG. 4, the needle bar drive mechanism 40 is a mechanism that converts the driving force of the sewing machine motor 16 transmitted via the drive shaft 17 from a rotary motion to an up-and-down motion, and thus drives the needle bar 30 up and down. The needle bar drive mechanism 40 is provided with a base needle bar 41, a drive member 42, a crank rod 46, a needle bar crank 47 and the like. The base needle bar 41 is a substantially column-shaped rod member that extends in the up-down direction. The base needle bar 41 is provided to the rear of the needle bar 30, and is disposed in parallel with the needle bar 30. The drive member 42 is externally fitted to the base needle bar 41, and is provided such that it can move up and down but cannot rotate with respect to the base needle bar 41. The drive member 42 has an upper end portion 43, a lower end portion 44 and an intermediate portion 45. The upper end portion 43 and the lower end portion 44 are each externally fitted to the base needle bar 41, and are disposed with a gap therebetween in the up-down direction. The intermediate portion 45 is provided so as to be separated from the base needle bar 41, and is connected to each of the upper end portion 43 and the lower end portion 44. The needle bar release mechanism 50 to be described later is provided between the upper end portion 43 and the lower end portion 44.

The crank rod 46 is formed in a long shape, and couples the lower end portion 44 of the drive member 42 and the needle bar crank 47. The needle bar crank 47 is fixed to a front end portion of the drive shaft 17, and rotates integrally with the drive shaft 17. One end portion (an upper end portion) of the crank rod 46 is rotatably coupled to the needle bar crank 47, and the other end portion (a lower end portion) is rotatably coupled to the lower end portion 44 of the drive member 42. Therefore, a rotary motion of the drive shaft 17 and the needle bar crank 47 is converted to an up-and-down motion of the lower end portion 44 of the drive member 42 by the crank rod 46. Thus, the drive member 42 reciprocates in the up-down direction along the base needle bar 41. In a state in which the needle bar release mechanism 50 connects the transmission of the driving force to the needle bar 30, the driving force of the sewing machine motor 16, which is transmitted to the needle bar drive mechanism 40 via the drive shaft 17, is transmitted to the needle bar 30. In this case, the needle bar release mechanism 50 and the needle bar 30 reciprocate in the up-down direction in conjunction with the drive member 42 that reciprocates in the up-down direction along the base needle bar 41.

The needle bar release mechanism 50 is a mechanism that connects or blocks the transmission of the driving force of the sewing machine motor 16 from the needle bar drive mechanism 40 to the needle bar 30. The needle bar release mechanism 50 is provided with a transmission member 51 and a coil spring 55. The transmission member 51 is externally fitted to the base needle bar 41, and is provided such that it can move up and down and can rotate with respect to an outer peripheral surface of the base needle bar 41. The transmission member 51 is provided with an upper engagement protrusion 52, a lower engagement protrusion 53 and an abutment pillar 54 (refer to FIG. 5 and FIG. 6). The upper engagement protrusion 52 and the lower engagement protrusion 53 protrude outwardly in a radial direction from an outer peripheral surface of the transmission member 51, and have a gap therebetween in the up-down direction.

Figure 5:
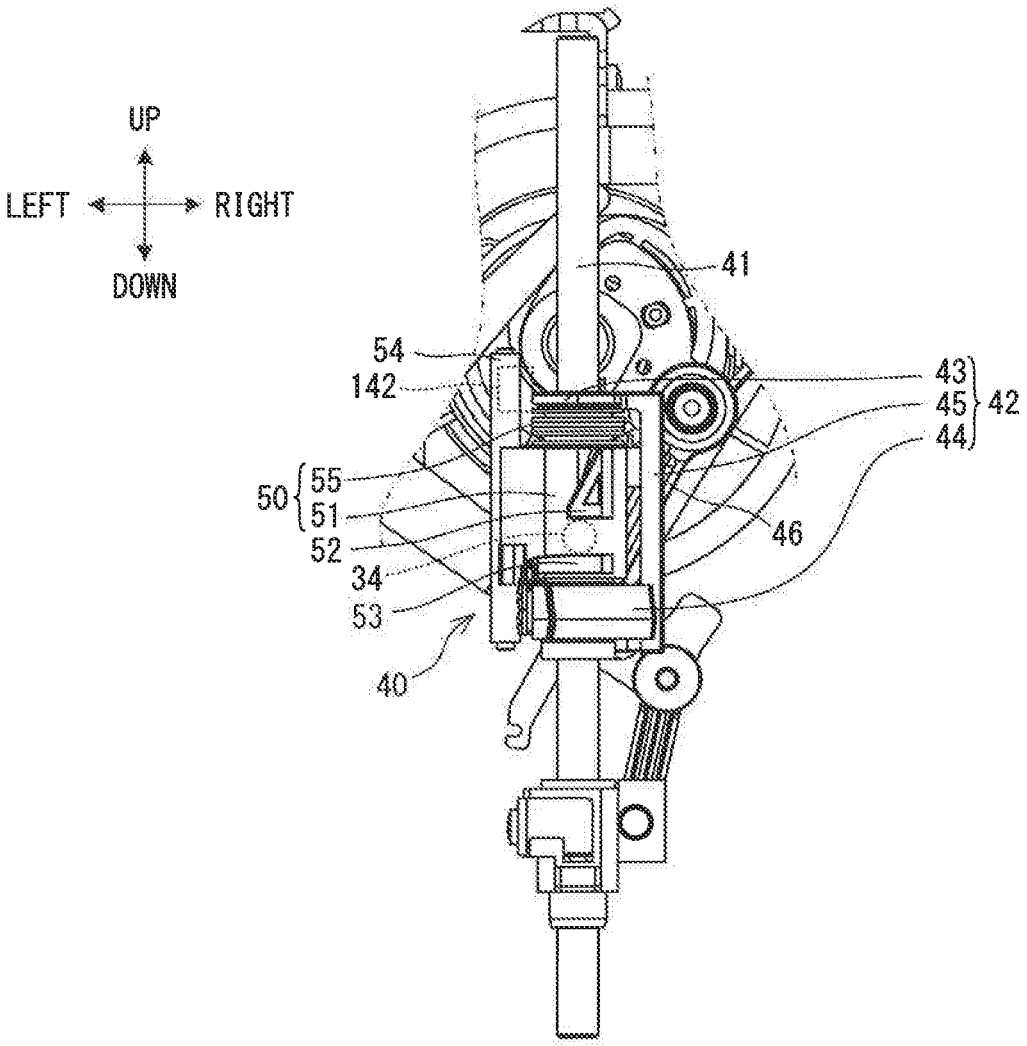
FIG. 5 is a front view of a needle bar drive mechanism and a needle bar release mechanism.
Figure 6:
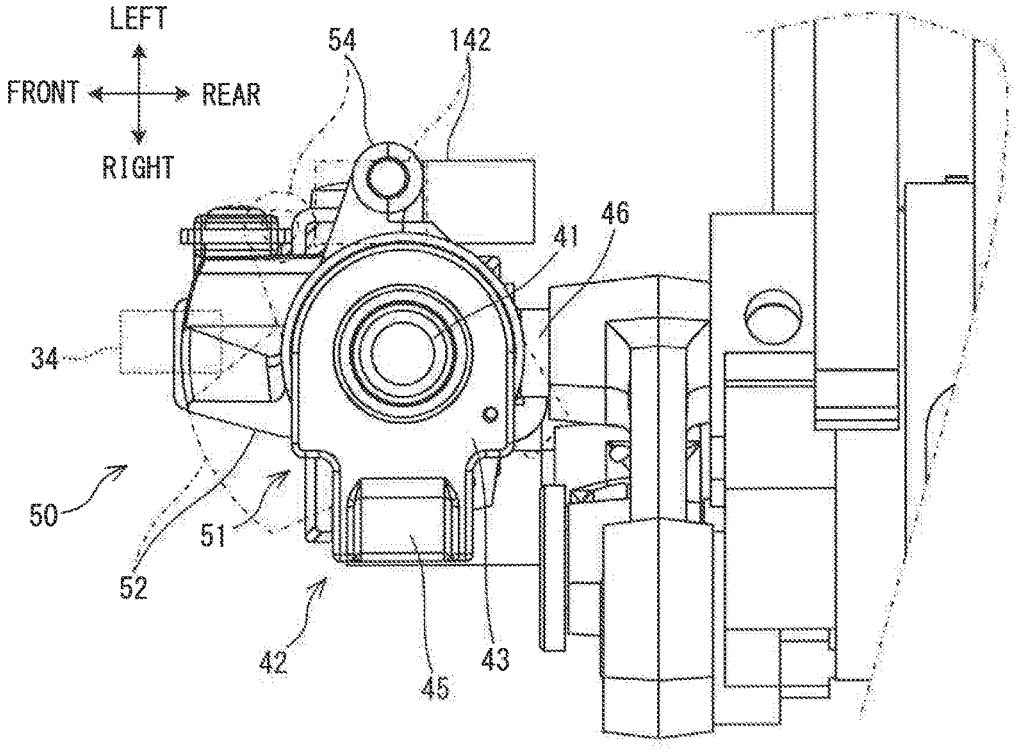
FIG. 6 is a plan view of the needle bar drive mechanism and the needle bar release mechanism.

As shown in FIG. 5, the upper engagement protrusion 52 is formed as an inclined surface shape such that the top surface is inclined diagonally left downward. The coupling pin 34 of the needle bar 30 is engaged between the upper engagement protrusion 52 and the lower engagement protrusion 53. The abutment pillar 54 is formed in a rod shape that extends in the up-down direction, and is provided on a section that protrudes outward in the radial direction from the outer peripheral surface of the transmission member 51. A first pin 142 of the drive unit (not shown in the drawings) abuts against the abutment pillar 54 from the rear side. When the abutment pillar 54 is pressed forward by the first pin 142 (shown by a dashed line in FIG. 6), the transmission member 51 rotates in the counterclockwise direction in a plan view (refer to FIG. 6). The upper engagement protrusion 52 and the lower engagement protrusion 53 of the transmission member 51 move to a position diagonally to the front and right of the base needle bar 41. In this case, the engagement of the upper engagement protrusion 52 and the lower engagement protrusion 53 with the coupling pin 34 of the needle bar 30 is released. When the transmission of the driving force from the needle bar drive mechanism 40 to the needle bar 30 is blocked, the needle bar 30 moves upward due to the urging force of the compression spring, and is positioned at the top dead center.

The coil spring 55 is connected to an upper portion of the transmission member 51, and is externally fitted to the upper end portion 43 of the drive member 42. The coil spring 55 urges the transmission member 51 in the clockwise direction in a plan view with respect to the drive member 42. When the abutment pillar 54 of the transmission member 51 is not pressed by the first pin 142 of the drive unit (not shown in the drawings), the transmission member 51 is rotated by the coil spring 55. The upper engagement protrusion 52 and the lower engagement protrusion 53 move to the front of the base needle bar 41. More specifically, the upper engagement protrusion 52 and the lower engagement protrusion 53 move to a position where they can engage with the coupling pin 34 of the needle bar 30.

When the sewing machine 1 having the above-described structure is used, the control portion of the sewing machine 1 drives the sewing machine motor 16, and causes the drive member 42 of the needle bar drive mechanism 40 to move upward along the base needle bar 41. When the transmission member 51 of the needle bar release mechanism 50 is moved upward by the drive member 42, the upper engagement protrusion 52 abuts against the coupling pin 34 of the needle bar 30 from below. The coupling pin 34 presses the top surface of the upper engagement protrusion 52 formed as the inclined surface shape, and causes the transmission member 51 to rotate in the counterclockwise direction in a plan view. When the transmission member 51 further moves upward and the upper engagement protrusion 52 is positioned to be higher than the coupling pin 34, the upper engagement protrusion 52 and the lower engagement protrusion 53 are moved to the front of the base needle bar 41 by the coil spring 55. The coupling pin 34 is interposed between the upper engagement protrusion 52 and the lower engagement protrusion 53, and the coupling member 33 of the needle bar 30 engages with the transmission member 51 of the needle bar release mechanism 50. Thus, the sewing machine 1 is brought into a connected state in which the transmission of the driving force of the sewing machine motor 16 is connected between the needle bar 30 and the drive shaft 17.

The structure of the cloth presser drive mechanism 60 will be explained with reference to FIG. 2 to FIG. 4. The cloth presser drive mechanism 60 is a mechanism that causes the cloth presser foot 38 to move up and down in synchronization with the up and down movement of the needle bar 30. The cloth presser drive mechanism 60 is provided with a presser member 111, a presser holder 113, a presser spring 114, the composite cam 70, a forked member 80, a drive mechanism 90 and the like. As shown in FIG. 3, the presser member 111 is formed in a substantially L shape in a side view, and a lower end portion thereof is provided with an annular portion 112. The needle bar 30 is inserted inside the annular portion 112 in the up-down direction. The above-described cloth presser foot 38 is coupled to an outside portion of the annular portion 112 such that the cloth presser foot 38 extends downward. The presser holder 113 is fixed to an upper end portion of the presser member 111 by a screw. A through hole (not shown in the drawings) that penetrates in the up-down direction is formed in the presser holder 113. The needle bar 30 is inserted through the through hole. Further, a back surface of the presser holder 113 is provided with an abutted portion 115 (refer to FIG. 4) that protrudes rearward. The abutted portion 115 is inserted into a guide groove 31A (refer to FIG. 2), which is formed in a guide plate 39 fixed to the needle bar frame 31 and which extends in the up-down direction. Therefore, the presser holder 113 and the presser member 111 are provided such that they can move up and down but cannot rotate with respect to the needle bar 30. The presser spring 114 is a coil spring, for example, and is mounted on the needle bar 30 at an upper end portion of the presser holder 113. The upper end of the presser spring 114 abuts against a lower portion of the coupling member 33. Therefore, the presser spring 114 is guided by the needle bar 30, and constantly urges the presser holder 113 downward.

The structure of the composite cam 70 will be explained with reference to FIG. 10 to FIG. 13. The composite cam 70 is fixed to the back surface side of the needle bar crank 47, on the front end side of the drive shaft 17. The composite cam 70 is provided with a main body cam 71, an auxiliary cam 72 and the thread take-up lever cam 73, in that order from one end side toward the other end side in an axis line direction, and is provided with a shaft hole 75 that penetrates along an axial center. The composite cam 70 is fixed such that the drive shaft 17 is inserted through the shaft hole 75. The main body cam 71 has a shape in which a part of a general triangular cam shape is deformed. This is in order for a movement trajectory of the up and down movement of the cloth presser foot 38 to be a more favorable trajectory than that in a structure using the general triangular cam. Note that the movement trajectory of the cloth presser foot 38 is represented by, for example, the height of the cloth presser foot 38 from the top surface of the needle plate 11 at every predetermined angle when the drive shaft 17 rotates once. An outer peripheral surface of the main body cam 71 is provided with a first cam surface 71A.

An outer peripheral surface of the auxiliary cam 72 is provided with a second cam surface 72A. The second cam surface 72A has a cam shape by which a distance of clamping on the inside of the forked member 80, which will be described later, is kept constant. In known sewing machines, there is a sewing machine having a structure in which a single triangular cam only is used to move a cloth presser foot up and down. In this case, the movement trajectory of the up and down movement of a cloth presser foot depends on the shape of the triangular cam. Therefore, if the shape of the triangular cam is deformed in order to change the movement trajectory, the outer diameter dimension of the triangular cam becomes non-uniform. More specifically, the distance of clamping on the inside of a forked member is not constant, and therefore, the swinging motion of the forked member becomes unstable. As a result, with the single triangular cam, the design freedom is restricted. In contrast to this, the composite cam 70 of the present embodiment is provided with the auxiliary cam 72, in addition to the main body cam 71. Therefore, in accordance with the cam shape of the main body cam 71, the distance of clamping on the inside of the forked member 80 can be kept constant. Thus, in the sewing machine 1, it is possible to inhibit limitation of the design freedom of the movement trajectory.

The thread take-up lever cam 73 is provided coaxially with the shaft hole 75, and is formed in a substantially circular shape when viewed from the axial direction. The thread take-up lever cam 73 is a known end face cam, and is provided with a third cam surface 73A formed by an end face that faces the rear end side in the axial direction. The roller of the sliding portion 206, which is provided on a rear end portion of the link member 200 of the thread take-up lever mechanism 20, abuts against and slides on the third cam surface 73A. Since the thread take-up lever cam 73 is provided integrally with the composite cam 70, it is possible to downsize the thread take-up lever mechanism 20 of the sewing machine 1.

Figure 13:
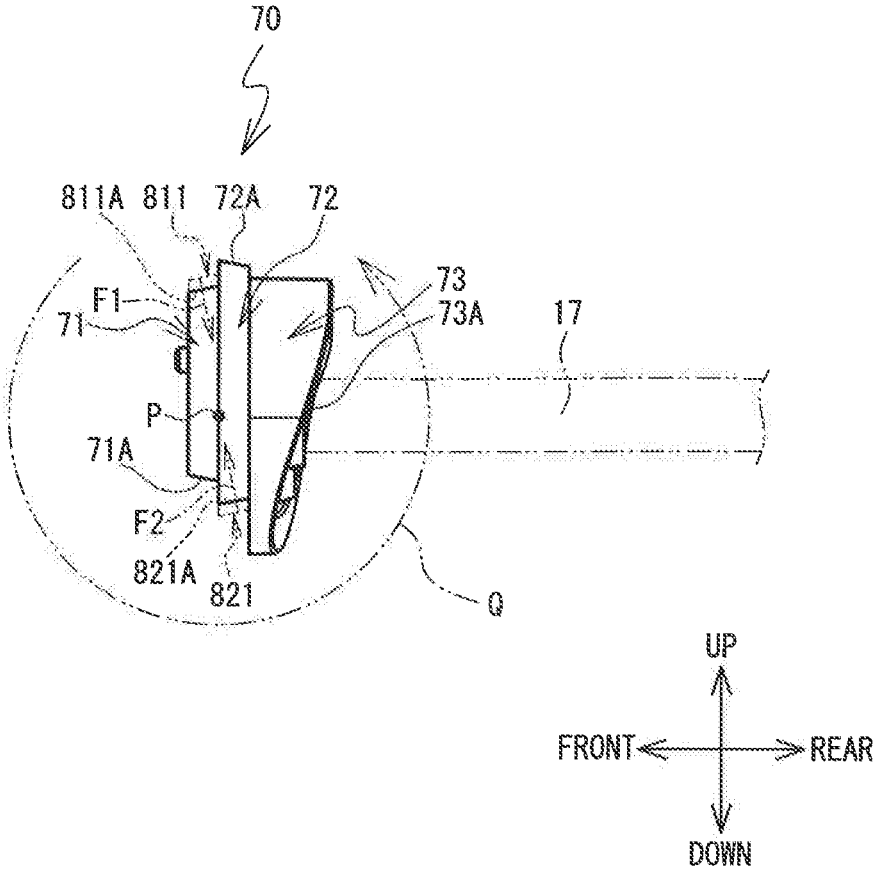
FIG. 13 is a side view of the composite cam.

Inclinations of the first cam surface 71A and the second cam surface 72A will be explained with reference to FIG. 13. The first cam surface 71A of the main body cam 71 is an inclined surface that is inclined downwardly from the rear to the front in an extending direction of the drive shaft 17. The first cam surface 71A of the main body cam 71 is an inclined surface that is inclined such that it becomes closer to the drive shaft 17 side the further it is toward an opposite side to the auxiliary cam 72 side. The angle of inclination of the first cam surface 71A is less than 1°, for example. Meanwhile, in contrast to the first cam surface 71A, the second cam surface 72A of the auxiliary cam 72 is an inclined surface that is inclined downwardly from the front to the rear in the extending direction of the drive shaft 17. The second cam surface 72A of the auxiliary cam 72 is an inclined surface that is inclined such that it becomes closer to the drive shaft 17 side the further it is toward an opposite side to the main body cam 71 side. The angle of inclination of the second cam surface 72A is also less than 1°, for example. Note that, for explanatory convenience, the angle of inclination of each of the first cam surface 71A and the second cam surface 72A shown in FIG. 13 is exaggerated and shown as an angle larger than 1°. A main body side abutment portion 811, to be described later, of the forked member 80 abuts against the first cam surface 71A. An auxiliary side abutment portion 821, to be described later, of the forked member 80 abuts against the second cam surface 72A.

The structure of the forked member 80 will be explained with reference to FIG. 2 and FIG. 7. The forked member 80 is provided with a main body member 81, an auxiliary member 82, a tension spring 83 and the like. The main body member 81 is formed in a substantially L shape in a front view. The main body member 81 is rotatably and axially supported by a pivotally supporting shaft 98 at a substantially central section of the main body member 81 that bends in the substantially L shape. Therefore, the forked member 80 can swing around the pivotally supporting shaft 98. The pivotally supporting shaft 98 extends in the front-rear direction and is provided on a front left portion of the machine frame 5A. The main body member 81 is provided with the main body side abutment portion 811 and a support portion 812. The main body side abutment portion 811 extends upward and diagonally to the right from the pivotally supporting shaft 98, and is provided with a contact surface 811A on a side that faces the composite cam 70. The contact surface 811A comes into contact with the first cam surface 71A of the main body cam 71 of the composite cam 70. The contact surface 811A is inclined in the same direction as the inclination direction of the first cam surface 71A so that the contact surface 811A comes into close contact with the inclined surface of the first cam surface 71A. The support portion 812 extends downward and diagonally to the right from the pivotally supporting shaft 98. A lower end portion of the support portion 812 is rotatably coupled to one end portion of a push-up link 88 of the drive mechanism 90 to be described later.

The auxiliary member 82 is formed in a substantially straight line, and is disposed such that the composite cam 70 is interposed between the inner sides of the auxiliary member 82 and the main body side abutment portion 811 of the main body member 81. Therefore, the main body member 81 and the auxiliary member 82 are formed in a forked shape as a whole. The auxiliary member 82 is provided with a support shaft 85 that extends to the front. The support shaft 85 is inserted through a through hole (not shown in the drawings), which is formed in the support portion 812 of the main body member 81 and which extends in the front-rear direction, and is inhibited from slipping out by a retaining ring (not shown in the drawings). In this manner, the auxiliary member 82 is supported by the main body member 81 such that the auxiliary member 82 can swing around the support shaft 85. The auxiliary member 82 is provided with the auxiliary side abutment portion 821 and a support portion 822. The auxiliary side abutment portion 821 extends upward and diagonally to the left from the support shaft 85, and is provided with a contact surface 821A on a side that faces the composite cam 70. The contact surface 821A abuts against the second cam surface 72A of the auxiliary cam 72 of the composite cam 70. The contact surface 821A is inclined in the same direction as the inclination direction of the second cam surface 72A so that the contact surface 821A comes into close contact with the inclined surface of the second cam surface 72A. The support portion 822 extends downward and diagonally to the left from the support shaft 85.

The tension spring 83 is stretched between the lower end portion of the support portion 812 of the main body member 81 and a lower end portion of the support portion 822 of the auxiliary member 82. The tension spring 83 constantly urges the lower end portion of the support portion 822 such that the lower end portion of the support portion 822 is pulled toward the lower end portion side of the support portion 812. In other words, the tension spring 83 constantly urges the lower end portion of the support portion 822 to an opposite side to the composite cam 70 side. Therefore, the auxiliary member 82 rotates in the counterclockwise direction in a front view around the support shaft 85. The auxiliary side abutment portion 821 of the auxiliary member 82 constantly abuts against the second cam surface 72A of the auxiliary cam 72. Thus, the forked member 80 can reliably clamp the composite cam 70.

Here, a position at which the tension spring 83 is attached will be explained. As shown in FIG. 2 and FIG. 7, in the present embodiment, a surrounding area of the forked member 80 on the side that comes into contact with the composite cam 70 is narrow because a plurality of other members, such as the machine frame 5A, the crank rod 46 and the like, are disposed on that side. Therefore, it is difficult to attach the tension spring 83 to the side, of the forked member 80, that comes into contact with the composite cam 70. To address this, in the present embodiment, as described above, the tension spring 83 is attached such that it is stretched between the lower end portion of the support portion 812 of the main body member 81 and the lower end portion of the support portion 822 of the auxiliary member 82. Thus, in the sewing machine 1, the tension spring 83 is disposed in a space that is spatially sufficient, on the opposite side to the side, of the forked member 80, that comes into contact with the composite cam 70. It is thus possible to effectively use a limited space inside the head portion 5 of the sewing machine 1.

The structure of the drive mechanism 90 will be explained with reference to FIG. 2, FIG. 4 and FIG. 7. The drive mechanism 90 is provided with a push-up rod 91 and an ascending/descending portion 92. The push-up rod 91 is formed in a rod shape, and one end portion thereof is rotatably coupled to the lower end portion of the support portion 812 of the main body member 81. The ascending/descending portion 92 is provided with a cylindrical portion 93 and a coupling portion 94. The cylindrical portion 93 is mounted on the lower end side of the base needle bar 41, and can ascend and descend along the base needle bar 41. The coupling portion 94 is provided integrally with a right side portion of the cylindrical portion 93, and is rotatably coupled to the other end portion of the push-up rod 91. As shown in FIG. 4, a front side portion of an outer peripheral surface of the cylindrical portion 93 is provided with a substantially L shaped abutment portion 95 that protrudes forward substantially horizontally. A buffer member 96 is fixed to a top surface of the abutment portion 95. The buffer member 96 is made of resin or rubber and is formed in a plate shape. A bottom surface of the abutted portion 115, which protrudes rearward from the back surface of the presser holder 113, can abut against a top surface of the buffer member 96. The buffer member 96 alleviates an impact when the top surface of the abutment portion 95 abuts against the bottom surface of the abutted portion 115.

As described above, the presser spring 114 mounted on the needle bar 30 constantly urges the presser holder 113 downward. As a result, the abutted portion 115 provided on the presser holder 113 urges the abutment portion 95 downward. Thus, the lower end portion of the support portion 812 of the main body member 81 is urged downward via the ascending/descending portion 92 and the push-up rod 91. Therefore, the forked member 80 constantly presses and urges the composite cam 70 in the clockwise direction around the pivotally supporting shaft 98.

The operation of the cloth presser drive mechanism 60 will be explained with reference to FIG. 4 and FIG. 7 to FIG. 9. When the sewing machine motor 16 is driven, the drive shaft 17 rotates. In accordance with the rotation of the drive shaft 17, the composite cam 70 rotates. The contact surface 811A of the main body side abutment portion 811 of the forked member 80 slides with respect to the first cam surface 71A of the main body cam 71. The contact surface 821A of the auxiliary side abutment portion 821 of the forked member 80 slides with respect to the second cam surface 72A of the auxiliary cam 72. Thus, the forked member 80 swings around the pivotally supporting shaft 98.

Figure 7:
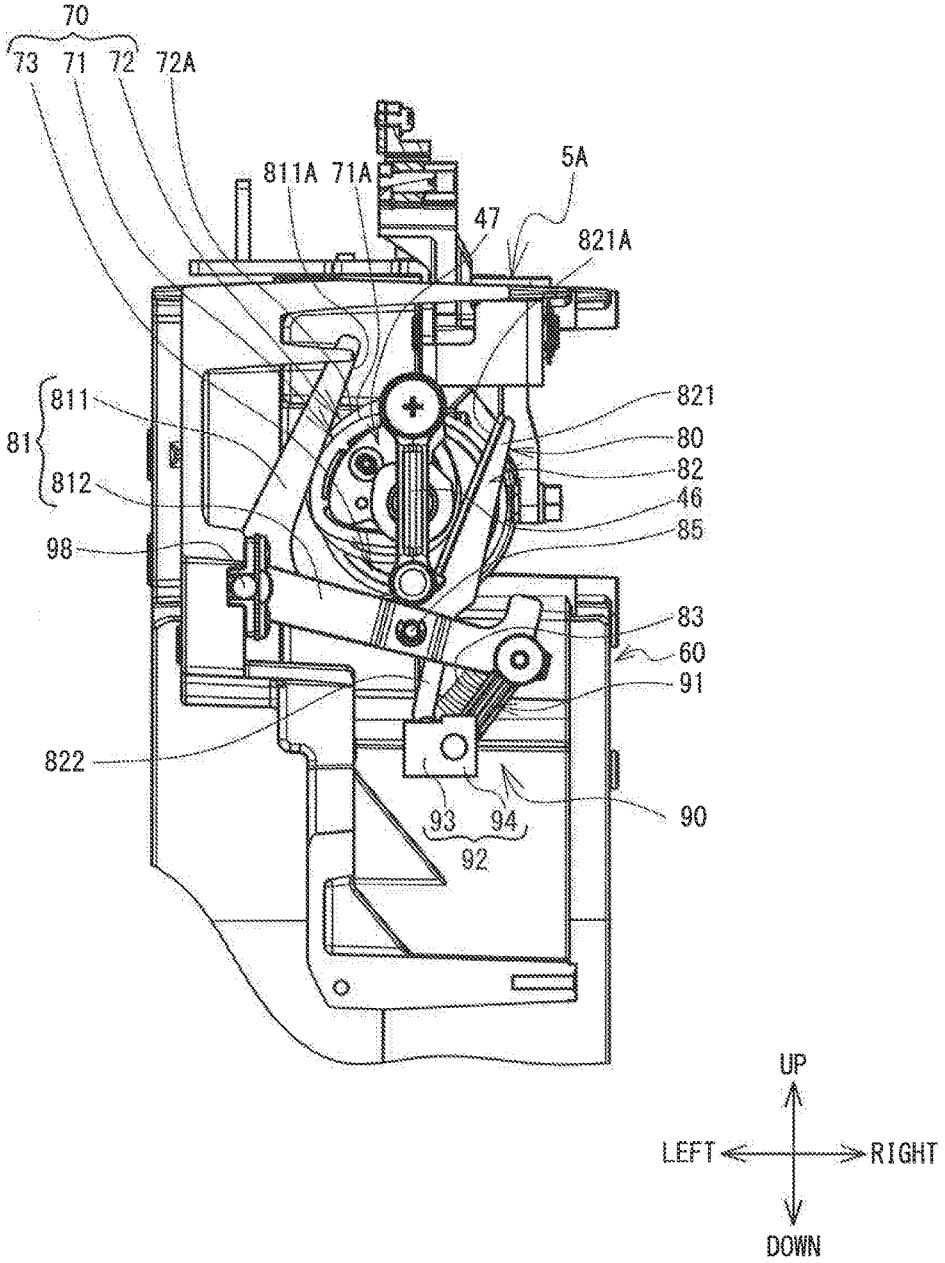
FIG. 7 is a diagram showing a swinging motion of a forked member (where a drive shaft angle=0°)
Figure 8:
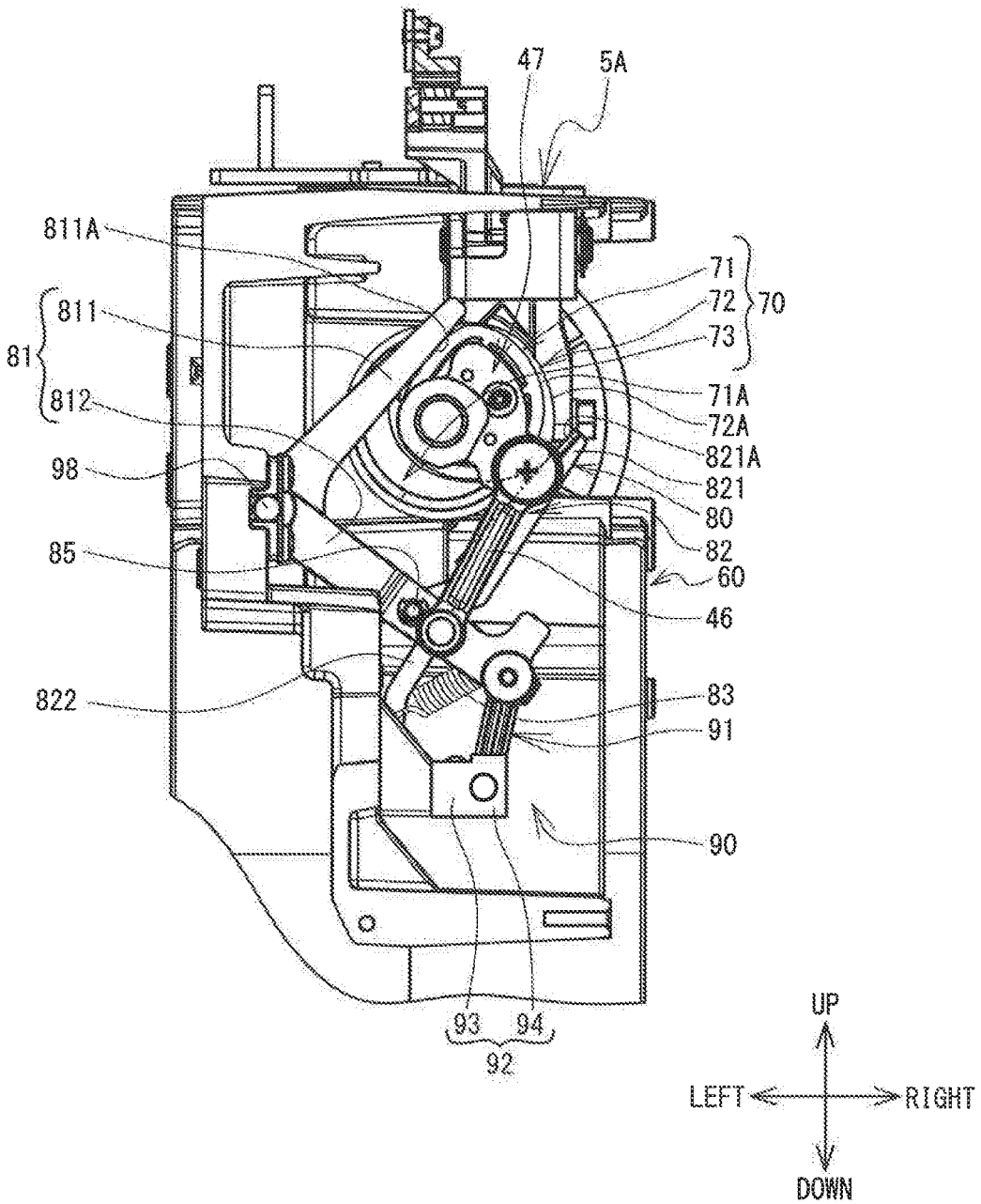
FIG. 8 is a diagram showing a swinging motion of the forked member (where the drive shaft angle=120°)

FIG. 7 shows a position of the forked member 80 when a drive shaft angle is 0°. When the drive shaft 17 rotates in the clockwise direction from this state and the drive shaft angle becomes 120°, the forked member 80 swings around the pivotally supporting shaft 98 in the clockwise direction, as shown in FIG. 8. At this time, the lower end portion of the support portion 812 of the main body member 81 moves downward, and thus pushes the ascending/descending portion 92 downward via the push-up rod 91. In response to this, the abutment portion 95, which has been pushing up the abutted portion 115 of the presser holder 113 from below until this time, moves downward. Thus, the presser holder 113 is pushed down by the urging force of the presser spring 114. Therefore, the presser member 111 and the cloth presser foot 38 move downward.

Figure 9:
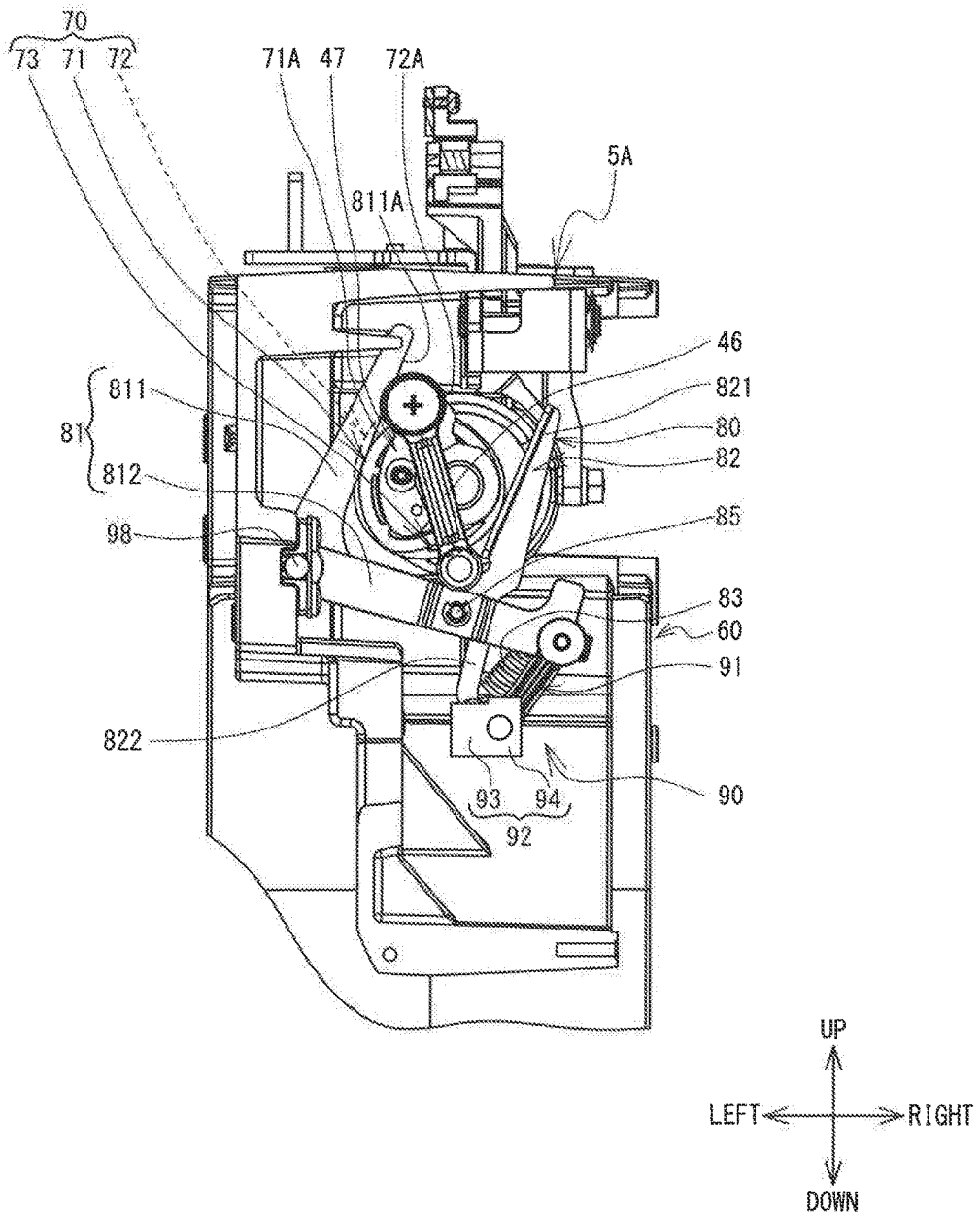
FIG. 9 is a diagram showing a swinging motion of the forked member (where the drive shaft angle=330°)

After the drive shaft 17 further rotates in the clockwise direction and the needle bar 30 reaches a bottom dead center, the forked member 80 reverses the swing direction and starts to swing in the counterclockwise direction. As shown in FIG. 9, when the drive shaft angle is 330°, the lower end portion of the support portion 812 of the main body member 81 moves upward, and thus pulls up the ascending/descending portion 92 via the push-up rod 91. The abutment portion 95 of the ascending/descending portion 92 pushes up the abutted portion 115 of the presser holder 113 in resistance to the urging force of the presser spring 114. As a result, the presser holder 113 moves upward, and thus the presser member 111 and the cloth presser foot 38 move upward. The cloth presser drive mechanism 60 repeats the above-described operation, and thus can perform a reciprocating motion of the presser foot 38 in the up-down direction. Note that, in the present embodiment, the presser member 113 and the cloth presser foot 38 perform a reciprocating motion of an up and down stroke of 10 to 12 mm, for example. Therefore, in the sewing machine 1, the reciprocating motion of the cloth presser foot 38 in the up-down direction can be performed in synchronization with the up and down motion of the needle bar 30.

Operational effects obtained by causing the first cam surface 71A and the second cam surface 72A of the composite cam 70 to be inclined will be explained with reference to FIG. 13. As described above, the contact surface 811A of the main body side abutment portion 811 of the forked member 30 abuts against the first cam surface 71A of the main body cam 71. Meanwhile, the contact surface 821A of the auxiliary side abutment portion 821 of the forked member 80 abuts against the second cam surface 72A of the auxiliary cam 72. That is, the position at which the contact surface 811A of the main body side abutment portion 811 abuts against the composite cam 70, and the position at which the contact surface 821A of the auxiliary side abutment portion 821 abuts against the composite cam 70 are displaced from each other in the extending direction of the drive shaft 17. Therefore, in the forked member 80, a rotational moment Q is likely to be generated around a center P in a direction orthogonal to the center line of the swing around the pivotally supporting shaft 98 that pivotally supports the forked member 80. If the rotational moment Q becomes larger, the forked member 80 tilts with respect to the extending direction of the drive shaft 17, and therefore, a load in a twist direction is applied to the pivotally supporting shaft 98. In this case, there is a possibility that the swing operation of the forked member 80 becomes unstable.

To address this, in the composite cam 70 of the present embodiment, the first cam surface 71A is formed as an inclined surface that is inclined downward from the rear to the front of the drive shaft 17, and the second cam surface 72A is formed as an inclined surface that is inclined downward from the front to the rear of the drive shaft 17, in a reverse manner to the first cam surface 71A. In other words, in the present embodiment, the first cam surface 71A and the second cam surface 72A are inclined in the opposite directions to each other. Thus, a force direction F1 in which the main body side abutment portion 811 abuts against the first cam surface 71A, and a force direction F2 in which the auxiliary side abutment portion 821 abuts against the second cam surface 72A can be caused to approach each other while facing each other. Then, the force direction F1 and the force direction F2 applied to the forked member 80 work to cancel each other out, and the sewing machine 1 can effectively reduce the rotational moment Q generated in the forked member 80. Thus, the load in the twist direction applied to the pivotally supporting shaft 98 is reduced, and the swing operation of the forked member 80 is stabilized. Thus, the sewing machine 1 can properly drive the cloth presser foot 38.

Further, the contact surface 811A of the main body side abutment portion 811 is inclined in the same direction as the inclination direction of the first cam surface 71A, and the contact surface 821A of the auxiliary side abutment portion 821 is inclined in the same direction as the inclination direction of the second cam surface 72A. Thus, the contact surface 811A and the contact surface 821A can uniformly come into contact with the first cam surface 71A and the second cam surface 72A. Therefore, the forked member 80 can swing stably. Further, since the contact surface 811A and the contact surface 821A uniformly come into contact with the first cam surface 71A and the second cam surface 72A, it is possible to reduce wear of the first cam surface 71A and the second cam surface 72A.

As explained above, the sewing machine 1 of the present embodiment is provided with the drive shaft 17, the composite cam 70, the forked member 80, the tension spring 83 and the cloth presser drive mechanism 60. The drive shaft 17 is rotated by the sewing machine motor 16. The composite cam 70 is provided with the main body cam 71 and the auxiliary cam 72, and is fixed to the drive shaft 17 so as to rotate integrally therewith. The main body cam 71 and the auxiliary cam 72 are provided side by side in the extending direction of the drive shaft 17. The first cam surface 71A is formed on the outer periphery of the main body cam 71. The second cam surface 72A is formed on the outer periphery of the auxiliary cam 72. The forked member 80 is swingably and pivotally supported by the pivotally supporting shaft 98 fixed to the machine frame 5A of the sewing machine 1. The forked member 80 is provided with the main body member 81 and the auxiliary member 82 that is swingably supported by the main body member 81. The pivotally supporting shaft 98 is provided parallel to the drive shaft 17. The forked member 80 is disposed such that the composite cam 70 is clamped between the main body member 81 and the auxiliary member 82, and the main body member 81 and the auxiliary member 82 respectively come into contact with the first cam surface 71A and the second cam surface 72A. The tension spring 83 constantly urges the auxiliary member 82 in a direction to clamp the composite cam 70 between the auxiliary member 82 and the main body member 81. The cloth presser drive mechanism 60 drives the cloth presser foot 38, by the swinging of the forked member 80 caused by the rotation of the composite cam 70.

In the sewing machine 1 provided with the above-described structure, the first cam surface 71A and the second cam surface 72A of the composite cam 70 are inclined with respect to the extending direction of the drive shaft 17. As a result, in the sewing machine 1, the direction in which the main body member 81 comes into contact with the composite cam 70 and the direction in which the auxiliary member 82 comes into contact with the composite cam 70 can be caused to approach each other while facing each other. It is therefore possible to reduce the rotational moment Q generated in the forked member 80. Thus, the load in the twist direction applied to the pivotally supporting shaft 98 is reduced, and the swing operation of the forked member 80 is stabilized. Thus, the sewing machine 1 can favorably drive the cloth presser foot 38.

Further, in the above-described embodiment, the contact surface 811A of the main body member 81 of the forked member 80 comes into contact with the first cam surface 71A, and the contact surface 821A of the auxiliary member 82 of the forked member 80 comes into contact with the second cam surface 72A. The contact surface 811A is inclined in the same direction as the inclination direction of the first cam surface 71A, and the contact surface 821A is inclined in the same direction as the inclination direction of the second cam surface 72A. Thus, the contact surfaces 811A and 821A can uniformly come into contact with the first cam surface 71A and the second cam surface 72A. Therefore, the forked member 80 can swing stably. Further, it is possible to reduce the wear of the first cam surface 71A and the second cam surface 72A.

Further, in the above-described embodiment, the first cam surface 71A is inclined such that it becomes closer to the drive shaft 17 side the further it is toward the opposite side to the auxiliary cam 72 side, and the second cam surface 72A is inclined such that it becomes closer to the drive shaft 17 side the further it is toward the opposite side to the main body cam 71 side. As a result, the direction in which the main body member 81 comes into contact with the composite cam 70 and the direction in which the auxiliary member 82 comes into contact with the composite cam 70 can be caused to approach each other while facing each other. It is therefore possible to suppress the rotational moment Q generated in the forked member 80.

Further, in the above-described embodiment, with respect to the support shaft 85 that swingably supports the auxiliary member 82, the tension spring 83 is connected to the lower end portion of the support portion 822 on the opposite side to the auxiliary side abutment portion 821 that comes into contact with the composite cam 70, and constantly urges the lower end portion to the opposite side to the composite cam 70 side. Thus, in the sewing machine 1, the tension spring 83 can be disposed in a spatially advantageous position, which is on the opposite side to the side, of the forked member 80, that comes into contact with the composite cam 70.

Further, in the above-described embodiment, the thread take-up lever cam 73, which is the end face cam that drives the thread take-up lever 19, is integrally provided in the composite cam 70. It is therefore possible to downsize the thread take-up lever mechanism 20.

Note that the present disclosure is not limited to the above-described embodiment, and various changes may be made without departing from the spirit and scope of the present disclosure. The sewing machine 1 of the present embodiment is an embroidery sewing machine having a single needle bar. However, for example, it may be a so-called multi-needle embroidery sewing machine having a plurality of needle bars.

Figure 14:
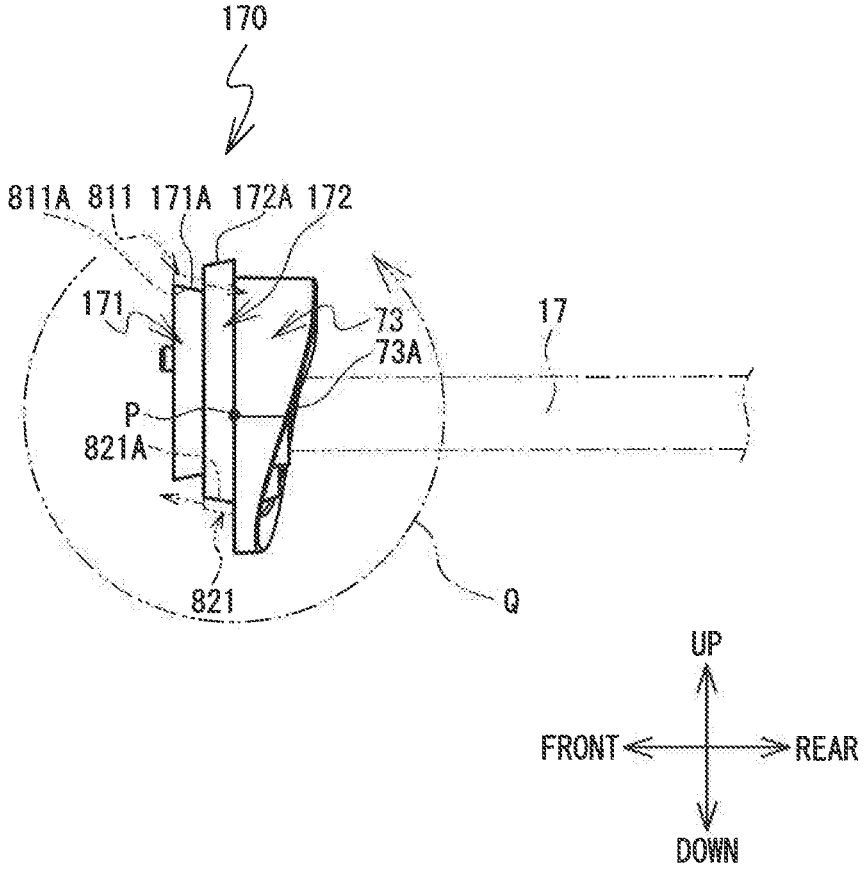
FIG. 14 is a side view of a composite cam.

Various modifications are possible to the composite cam 70 of the above-described embodiment. For example, the inclination directions of the first cam surface 71A and the second cam surface 72A may be changed. For example, a composite cam 170 shown in FIG. 14 is provided with a first cam 171, a second cam 172 and the thread take-up lever cam 73. In contrast to the above-described embodiment, a first cam surface 171A of the first cam 171 is inclined such that it becomes separated from the drive shaft 17 side the further it is toward an opposite side to the second cam 172 side. A second cam surface 172A of the second cam 172 is inclined such that it becomes separated from the drive shaft 17 side the further it is toward an opposite side to the first cam 171 side. Note that, for explanatory convenience, the angle of inclination of each of the first cam surface 171A and the second cam surface 172A shown in FIG. 14 is exaggerated and shown with an angle larger than an actual angle. This also applies to cam surfaces in FIG. 15 and FIG. 16 to be described later.

In the case of this structure, due to the urging force of the tension spring 83, in the main body side abutment portion 811 of the main body member 81 that abuts against the first cam surface 171A, a component of force is generated in the direction of movement to the second cam surface 172A side along the inclined surface of the first cam surface 171A. On the other hand, in the auxiliary side abutment portion 821 of the auxiliary member 82 that abuts against the second cam surface 172A, a component of force is generated in the direction of movement to the first cam surface 171A side along the inclined surface of the second cam surface 172A. As a result, the main body side abutment portion 811 and the auxiliary side abutment portion 821 operate so as to approach each other in the extending direction of the drive shaft 17. Therefore, the direction in which the main body member 81 comes into contact with the composite cam 170 and the direction in which the auxiliary member 82 comes into contact with the composite cam 170 can be caused to approach each other while facing each other. Therefore, in the sewing machine 1, although dependent on the urging force of the tension spring 83 and the angle of inclination of the first cam surface 171A and the second cam surface 172A, even when the composite cam 170 is used, it is possible to reduce the rotational moment Q generated in the forked member 80.

Further, in the composite cam 70 of the above-described embodiment and the composite cam 170 of the modified example, both of the first cam surface 71A (171) and the second cam surface 72A (172A) are inclined with respect to the extending direction of the drive shaft 17. However, only one of them may be inclined.

Figure 15:
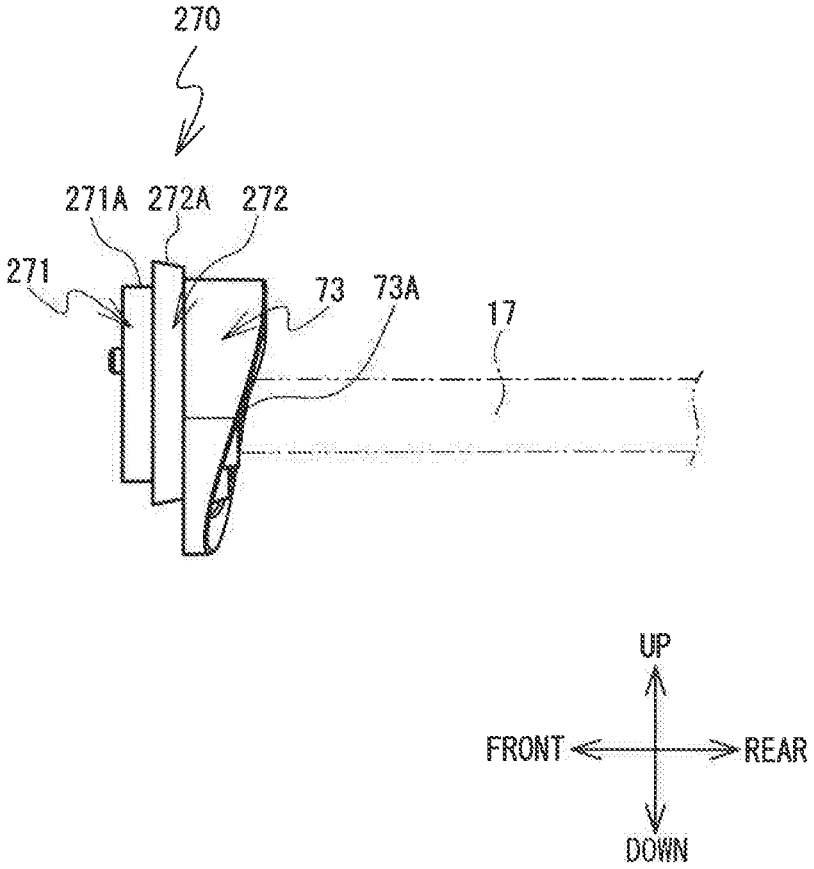
FIG. 15 is a side view of a composite cam.

For example, a composite cam 270 shown in FIG. 15 is provided with a first cam 271, a second cam 272 and a composite cam 873. A first cam surface 271A of the first cam 271 is parallel to the extending direction of the drive shaft 17. Meanwhile, a second cam surface 272A of the second cam 272 is inclined such that it becomes closer to the drive shaft 17 side the further it is toward an opposite side to the first cam 271 side.

Figure 16:
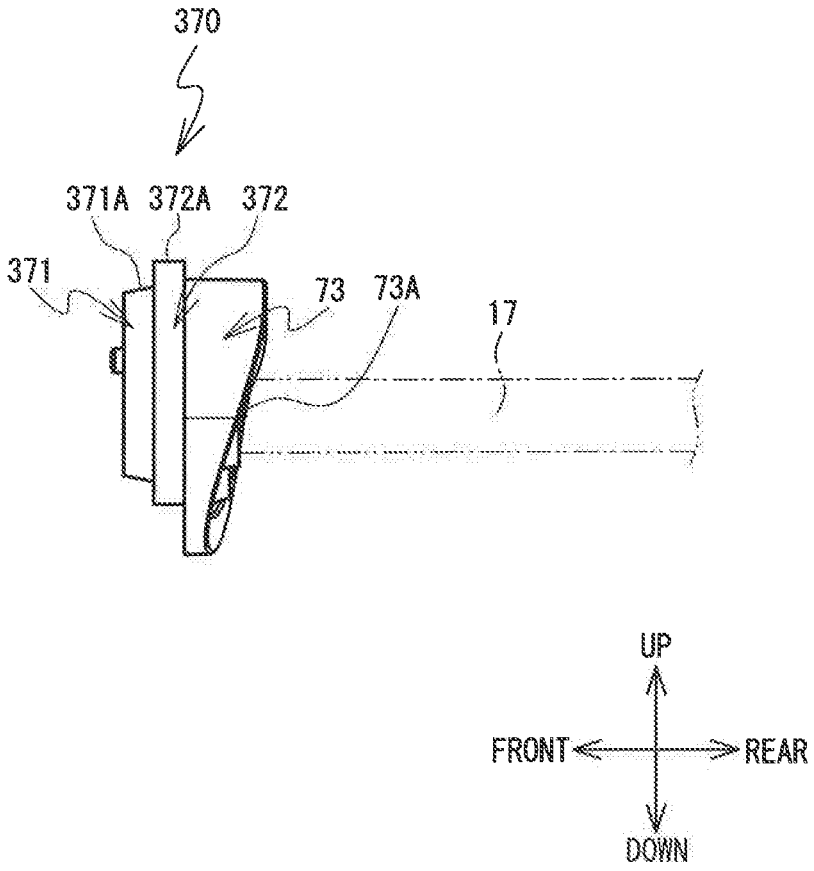
FIG. 16 is a side view of a composite cam.

A composite cam 370 shown in FIG. 16 is provided with a first cam 371, a second cam 372 and the composite cam 873. The second cam surface 272A of the second cam 272 is parallel to the extending direction of the drive shaft 17. Meanwhile, the first cam surface 371A of the first cam 371 is inclined such that it becomes closer to the drive shaft 17 side the further it is toward an opposite side to the second cam 372 side. Even when the composite cams 270 and 370 are used, it is possible to reduce the rotational moment Q generated in the forked member 80, in the same manner as in the above-described embodiment.

Note that the second cam surface 272A of the composite cam 270 may be inclined such that it becomes separated from the drive shaft 17 side the further it is toward the opposite side to the first cam 271 side. Further, the first cam surface 371A of the composite cam 370 may be inclined such that it becomes separated from the drive shaft 17 side the further it is toward the opposite side to the second cam 372 side.

Further, although the thread take-up lever cam 73 is provided integrally with the composite cam 70 of the above-described embodiment, the thread take-up lever cam 73 may be a separate body from the composite cam 70.

Figure 10:
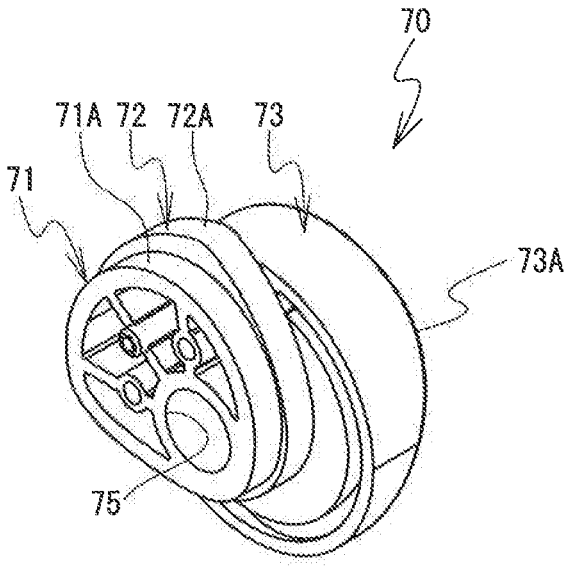
FIG. 10 is a perspective view of a composite cam.
Figure 11:
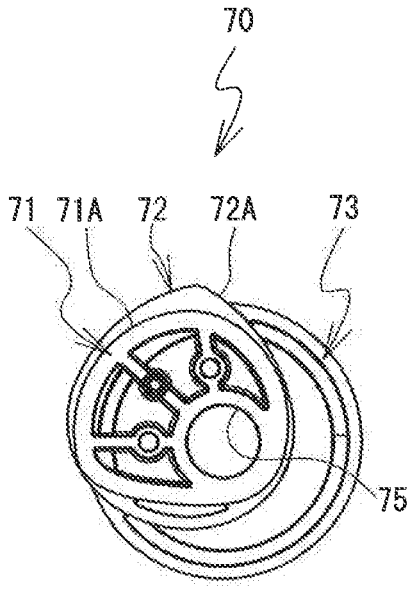
FIG. 11 is a front view of the composite cam.
Figure 12:
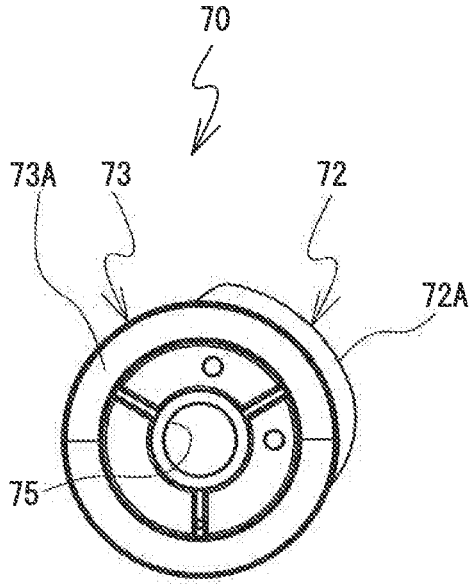
FIG. 12 is a rear view of the composite cam.

Further, the shape of the main body can 71 shown in FIG. 10 and FIG. 11 is not limited to that of the above-described embodiment, and may be changed as appropriate in accordance with a targeted movement trajectory of the cloth presser foot 38. The shape of the auxiliary cam 72 may be changed in accordance with the shape of the main body cam 71.

What is claimed is:

1. A sewing machine comprising:

a drive shaft configured to be rotated by a sewing machine motor;

a cam member including a first cam and a second cam, the first cam having an outer periphery on which a first cam surface is formed, the second cam having an outer periphery on which a second cam surface, whose shape is different from that of the first cam surface, is formed, the first cam and the second cam being provided side by side in an extending direction of the drive shaft, at least one of the first cam surface and the second cam surface being inclined with respect to the extending direction of the drive shaft, and the cam member being fixed to the drive shaft and rotating integrally with the drive shaft;

a forked member including a main body member and an auxiliary member, the main body member being swingably and pivotally supported by a pivotally supporting shaft fixed to a machine frame of the sewing machine, the pivotally supporting shaft being provided parallel to the drive shaft, the auxiliary member being swingably supported by the main body member, and the main body member and the auxiliary member being disposed to face each other such that the cam member is clamped between the main body member and the auxiliary member;

an urging device configured to constantly urge the main body member and the auxiliary member in a direction to clamp the cam member; and a presser mechanism configured to drive a presser member, which holds down a cloth, by swinging of the forked member caused by the rotation of the cam member.

2. The sewing machine according to claim 1, wherein the first cam surface and the second cam surface are inclined with respect to the extending direction of the drive shaft, and an inclination direction of the first cam surface and an inclination direction of the second cam surface are different from each other.

3. The sewing machine according to claim 1, wherein the main body member includes a main body side contact surface that comes into contact with one cam surface, of the first cam surface and the second cam surface, the auxiliary member includes an auxiliary side contact surface that comes into contact with another cam surface different from the one cam surface, of the first cam surface and the second cam surface, the main body side contact surface is inclined in the same direction as an inclination direction of the one cam surface, and the auxiliary side contact surface is inclined in the same direction as an inclination direction of the other cam surface.

4. The sewing machine according to claim 1, wherein the first cam surface is an inclined surface that becomes closer to the drive shaft side the further the first cam surface is toward an opposite side to the second cam side, and the second cam surface is an inclined surface that becomes closer to the drive shaft side the further the second cam surface is toward an opposite side to the first cam side.

5. The sewing machine according to claim 1, wherein the first cam surface is an inclined surface that becomes separated from the drive shaft side the further the first cam surface is toward an opposite side to the second cam side, and the second cam surface is an inclined surface that becomes separated from the drive shaft side the further the second cam surface is toward an opposite side to the first cam side.

6. The sewing machine according to claim 1, wherein the main body member includes a support shaft configured to swingably support the auxiliary member, the urging device is a tension spring, and the urging device is connected to a second end portion of the auxiliary member that is on an opposite side to a first end portion of the auxiliary member with respect to the support shaft, the first end portion coming into contact with the cam member, and the urging device constantly urges the second end portion to an opposite side to the cam member side.

7. The sewing machine according to claim 1, wherein a thread take-up lever cam, which is an end face cam that drives a thread take-up lever, is provided integrally with the cam member.

* * * * *